US005472658A

United States Patent [19]

Collins et al.

[11] Patent Number: 5,472,658

[45] Date of Patent: Dec. 5, 1995

[54] PRE-STRESSING OF HEAT TREATED LIQUID CRYSTALLINE POLYMER FIBER TO IMPROVE MODULUS

[75] Inventors: George Collins, Maplewood; William M. Pleban, Stanhope; Frank Haimbach, IV, Upper Montclair; John A. Flint, Berkeley Heights, all of N.J.

[73] Assignee: Holechst Celanese Corporation, Summit, N.J.

[21] Appl. No.: 171,589

[22] Filed: Dec. 22, 1993

[51] Int. Cl.[6] ..... D02J 1/20

[52] U.S. Cl. ..... 264/340

[58] Field of Search ..... 264/290.5, 290.7, 264/340

[56] References Cited

U.S. PATENT DOCUMENTS

| | | | |
|---|---|---|---|
| 4,161,470 | 7/1979 | Calundann | 524/599 |
| 4,183,895 | 1/1980 | Luise | 264/345 |
| 4,247,514 | 1/1981 | Luise | 264/345 |
| 4,393,191 | 7/1983 | East | 528/207 |
| 4,424,184 | 1/1984 | Eskridge et al. | 264/235 |
| 4,429,105 | 1/1984 | Charbonneau | 528/207 |
| 4,574,066 | 3/1986 | Gibbon et al. | 264/85 |
| 4,985,193 | 2/1989 | Allen | 264/184 |
| 5,204,443 | 4/1993 | Lee et al. | 528/184 |

OTHER PUBLICATIONS

Abstract of Japan 3–260,114 (Published Nov. 20, 1991).
Abstract of Japan 3–294,517 (Published Dec. 25, 1991).

*Primary Examiner*—Leo B. Tentoni

[57] ABSTRACT

The tensile modulus of fibers made from liquid crystalline polymers comprising 6-oxy-2-naphthoate and 4-oxybenzoate monomer units that have been heat treated can be increased by applying and then releasing a stress at room temperature in the range of about 25% to about 90% of the tensile strength of the heat treated fiber to yield a "pre-stressed" fiber.

21 Claims, 1 Drawing Sheet

PRE-STRESSING OF HEAT TREATED LIQUID CRYSTALLINE POLYMER FIBER TO IMPROVE MODULUS

FIELD OF THE INVENTION

This invention relates generally to fibers made from liquid crystalline polymers, and more specifically to fibers having improved modulus as a result of pre-stressing of the heat treated fiber at room temperature.

BACKGROUND OF THE INVENTION

It is well known that liquid crystalline polymers can be made into fibers having high strength and high modulus. Generally, the tensile properties of asspun fibers made from liquid crystalline polymers are improved significantly if the fibers are heated to elevated temperatures in an unstressed state for a period of hours. For comparison, semi-crystalline polymers that are not liquid crystalline, such as poly(ethylene terephthalate), develop their best properties when they are drawn to >100% of their original length by applying a stress at elevated temperatures.

There are a few reports of improvements in tensile properties of liquid crystalline polymers that are achieved by application of stress at elevated temperature. Thus, published Japanese Patent Application No. 91,260,114 describes the heat treatment of fibers of a polymer of 70% 4-oxybenzoyl and 30% 6-oxy-2-naphthoyl monomer units at elevated temperatures (240°–285° C.) with a small amount of stress (2-6 grams per denier) to yield fibers with higher tensile strength and tensile modulus than fibers obtained by heat treatment of unstressed fibers. Published Japanese Patent Application No. 91,294,517 describes improvements in tensile properties of fibers made from the polymer of 73% 4-oxybenzoyl and 27% 6-oxy-2-naphthoyl monomer units; the property improvements are obtained by heat treating the melt spun fiber at 260° C.–285° C., followed by drawing of the fibers at elevated temperature (e.g. 280° C). It appears that there are no reports of improvements in properties of heat treated thermotropic liquid crystalline polymers by applying a stress to the fiber at room temperature.

SUMMARY OF THE INVENTION

It has now been found that improvements in tensile properties, particularly modulus, can be achieved by applying and then releasing a stress at a relatively low temperature (approximately 10° C. to about 40° C., but preferably about 25° C.) to heat treated fibers that are made from an aromatic liquid crystalline polymer comprising monomer units I and II, where I is:

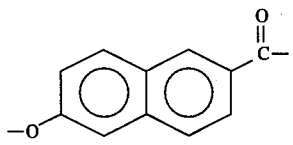

and II is

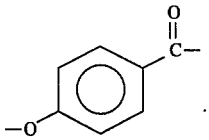

Monomer units I and II may optionally include substituents for some of the hydrogen atoms on the aromatic ring selected from the group consisting of alkyl groups having 1 to 4 carbon atoms, fluorinated alkyl groups having 1 to 4 carbon atoms, alkoxy groups having 1 to 4 carbon atoms, halogen atoms, phenyl groups and mixtures thereof. The fibers have been heat treated at elevated temperatures prior to the application of the stress. The applied stress is in the range of about 10% to about 90% of the tensile strength of the heat treated fiber. The stress is applied for a time sufficient to increase the modulus.

DESCRIPTION OF THE PREFERRED EMBODIMENTS

Figure 1:
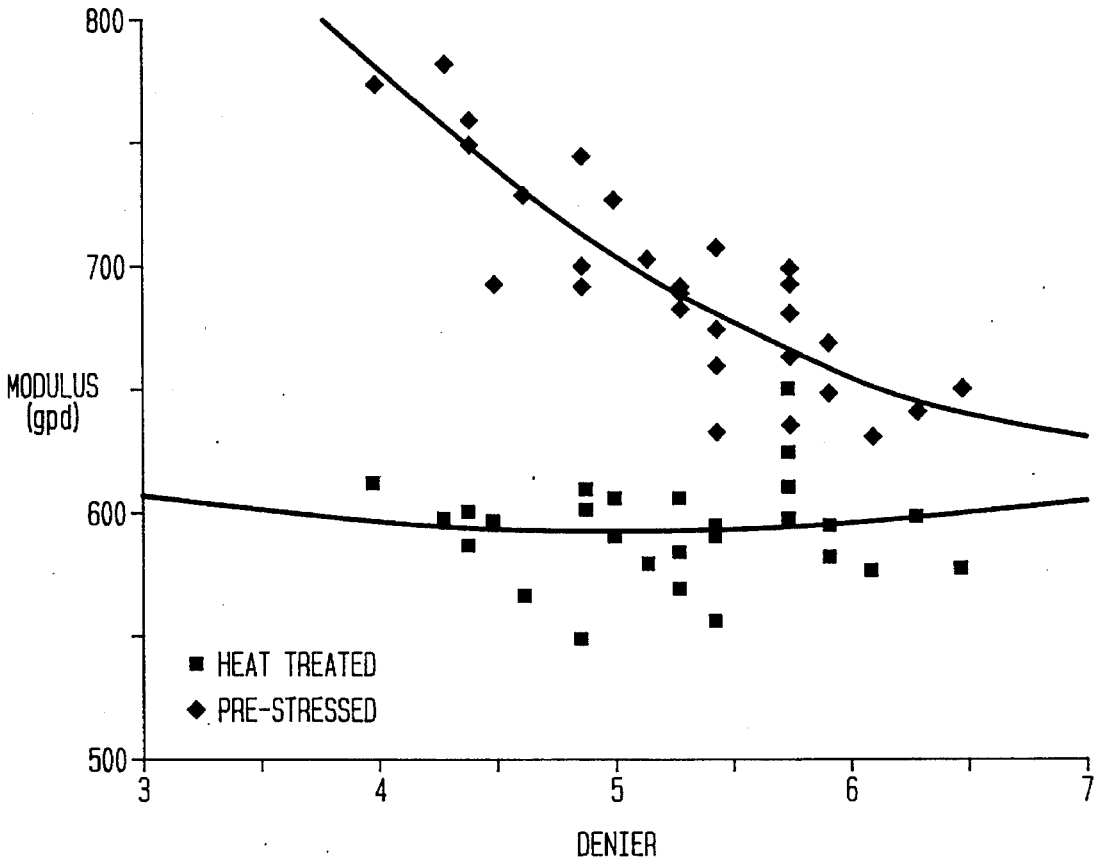
FIG. 1 is a plot showing the relationship between modulus and denier for the heat treated fiber and the pre-stressed fiber.

The improvement in properties obtained by the stressing of a heat treated fiber of a liquid crystalline polymer is particularly apparent for polymers that are made from about 10 to about 90 mole % of monomer unit I (6-oxy-2-naphthoyl) and about 90 to about 10 mole % of monomer unit II (4-oxybenzoyl), pictured above. Preferred compositions contain about 20 to about 45 mole % of monomer unit I and about 80 to about 55 mole % of monomer unit II, and most preferably about 27 mole % of monomer unit I and about 73 mole % of monomer unit II. The polymers useful for making fibers generally have an inherent viscosity of at least about 4 dl/gm, and generally in the range of about 4 to about 7 dl/gm, when measured as a 0.1% by weight solution in pentafluorophenol at 60° C.

The polymer, methods of making it, and methods of melt spinning it into fiber are well known in the art and are described in commonly assigned U.S. Pat. Nos. 4,161,470, 4,393,191 and 4,429,105. The property improvements that are obtained by heat treatment of fibers made of this and other liquid crystalline polymers are described in U.S. Pat. Nos. 4,161,470, 4,183,895, 4,247,514, 4,424,184 and 4,574,066. The most preferred polymer in the form of a heat treated fiber is available from Hoechst Celanese Corporation under the VECTRAN® trademark. It should be pointed out that the word "fiber" as used herein is meant to include both single filament fibers and other shaped forms of the polymer that utilize fibers, such as yarns made up of a multiplicity of filaments, which may be either twisted or untwisted. It should also be pointed out that the polymer compositions described herein are expressed as a mole % of the monomer units in the polymer unless stated otherwise.

Before the application of stress, the heat treated fiber made from the polymer comprising about 27 mole % of monomer unit I and about 73 mole % of monomer unit II generally has a tensile strength of at least about 20 grams per denier (gpd) and a tensile modulus of at least about 500 gpd, as measured by ASTM test method D-3822. Preferably, the tensile strength is about 25 gpd and the tensile modulus is about 550–600 gpd.

The modulus is improved by applying a tensile stress to the fiber in the range of about 10% to about 90% of the tensile strength of the heat treated fiber, preferably about 25% to about 80% of the tensile strength of the heat treated fiber, and most preferably about 75% of the tensile strength of the heat treated fiber. In a laboratory setting, the tensile stress was readily applied by stressing the fiber in an apparatus used for measuring tensile properties of fibers, such as an INSTRON® mechanical tester. In a commercial setting, the stress can be conveniently applied on a draw frame. The stress can be applied during the transfer of heat treated fiber or yarn from the bobbin on which it is heat treated to a standard bobbin by proper adjustment of the relative speeds of the two bobbins or by passing the yarn through a draw frame during the transfer.

The stress is applied for a time long enough to increase the modulus, and is on the order of about 0.1 seconds to about one minute, and preferably about one second to about one minute. Less than about one minute is normally sufficient to achieve the increase in modulus, though longer periods of stress are not expected to be detrimental.

The fiber obtained by this process is referred to herein as "pre-stressed," a name chosen to indicate that a stress has been applied before it is used in its intended application. The pre-stressed fiber that results from the process described herein has a modulus that is greater than the modulus of the heat treated fiber before the stress is applied. Generally, the modulus has increased by at least about 5%. Preferably, the modulus has increased by about 10% or more, and most preferably by about 20% or more. Increases as large as 30% have been observed. The tensile strengths of the fibers that have been subjected to stress at room temperature are not significantly changed.

It has also been surprisingly found that the increase in modulus varies with the denier of the fiber. This is shown in Table 1 of Example 1. Thus, it appears that the invention disclosed herein will give the largest improvements in modulus if pre-stressing of heat treated fiber is carried out on fiber having a denier per filament of less than about 10 dpf, preferably in the range of about 1 to about 10 dpf, and most preferably in the range of about 2 to about 6 dpf.

Finally, while the best results were obtained using a polymer of monomer units I and II, it has also been found that modest increases in modulus can be obtained by pre-stressing other thermotropic liquid crystalline polymers, such as polymers made up of about 1 to about 15 mole % of monomer unit I and about 20 to about 70 mole % of monomer unit II in combination with about 1 to about 40 mole % of monomer unit III, about 1 to about 40 mole % of monomer unit IV, and up to about 20 mole % of optional monomer unit V. In these polymers, III is $—O—A_1—O—$ IV is $$—\overset{O}{\overset{\|}{C}}—Ar_2—\overset{O}{\overset{\|}{C}}—$$

and V is $—X—Ar_3—NR—$ where $Ar_1$, $Ar_2$ and $Ar_3$ are each aromatic moieties selected from the group consisting of 1,3-phenylene, 1,4-phenylene, 2,6-naphthylene, 2,7-naphthylene, 4,4'-biphenylene, and mixtures thereof, where —X— is —O— or $$—\overset{O}{\overset{\|}{C}}—,$$

where R is H— or an alkyl group having one to four carbon atoms, and where $Ar_1$, $Ar_2$ and $Ar_3$ may optionally include substituents for some of the hydrogen atoms on the aromatic rings. These substituents may be alkyl groups having 1 to 4 carbon atoms, fluorinated alkyl groups having 1 to 4 carbon atoms, alkoxy groups having 1 to 4 carbon atoms, halogen atoms, phenyl groups and mixtures thereof.

For example, a higher modulus can be obtained by the pre-stressing at about room temperature of a heat treated fiber made from a polymer of about 1 to about 15 mole % of monomer unit I, about 40 to about 70 mole % of monomer unit II, about 10 to about 30 mole % of monomer unit III and about 10 to about 30 mole % of monomer unit IV, where III is

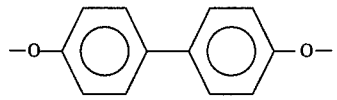

and IV is terephthalate. Preferably, this particular polymer is composed of about 4 mole % of monomer unit I, about 60 mole % of monomer unit II, and about 18 mole % each of monomer units III and IV.

Another suitable polymer composition whose properties can be improved by pre-stressing of a fiber at room temperature is a liquid crystalline poly(esteramide) made up of about 1 to about 15 mole % of monomer unit I, about 20 to about 70 mole % of monomer unit II, about 5 to about 40 mole % of monomer unit III, about 5 to about 40 mole % of monomer unit IV, and about 1 to about 20 mole % of monomer unit V, where III is

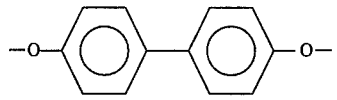

IV is terephthalate, and V is

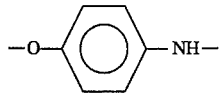

Preferably, this polymer is composed of about 3.5 mole % of monomer unit I, about 60 mole % of monomer unit II, about 13.25 mole % of monomer unit III, about 18.25 mole % of monomer unit IV, and about 5 mole % of monomer unit V.

The fibers made using the process described herein are useful in numerous applications where fiber reinforcement is desirable, such as ropes and reinforcement for belts.

Example 1

A polymer consisting essentially of monomer units derived from 73 mole % 4-hydroxybenzoic acid and 23 mole % 6-hydroxy-2-naphthoic acid was melt spun by extruding the molten polymer through a spinneret onto a bobbin at various take-up speeds to yield untwisted yarn samples having denier sizes in the range of about 4 dpf to about 6.5 dpf. These were annealed in a nitrogen purged oven to yield yarn samples having filaments with a tensile modulus of about 550–600 gpd and a tensile strength of about 25 gpd, as measured by ASTM Test Method D-3822.

Individual filaments from the yarn were placed in an INSTRON mechanical tester. They were stressed twice. First, they were stressed to a load of 19 gpd at a strain rate of 20% per minute. The stress was then released at the same rate (20% per minute, but decreasing) to zero. This corresponds to a total time from the start of application of stress until the stress returned to zero of about 25 sec. Stress was then applied for a second time at the same strain rate as before, but this time stress was applied until the fiber broke. The tensile modulus (the slope of the stress-strain curve) was measured during both applications of stress. The first application of stress also served as the pre-stressing of the heat treated fiber at room temperature. The second application of stress (to break) was used to measure the tensile strength and modulus of the pre-stressed fiber. The tensile strengths of the pre-stressed filaments were approximately the same as the tensile strength of the yarn before pre-stressing. The tensile modulus increased for each of the 29 filaments that were tested. The data are presented in Table 1. The modulus of the heat treated fiber in each test ("Heat Treated" modulus) and the modulus after. pre-stressing ("Pre-stressed") in gpd are shown, along with the denier of each filament. The % increase in modulus for each pre-stressing experiment is also shown. The increases varied from about 6%–30%, with the larger increases corresponding to the finer denier fibers. This is more readily observed in FIG. 1, where the "heat-treated" modulus and "pre-stressed" modulus are plotted as a function of denier. The heat treated modulus (i.e., before pre-stressing) did not vary with denier, whereas the modulus of the pre-stressed fiber increased with decreasing denier.

TABLE 1

| Single Filament Modulus of Pre-stressed Fibers | | | | |
|---|---|---|---|---|
| Test Number | Heat Treated Modulus | Pre-stressed Modulus | Denier | % Increase |
| 1 | 595 | 633 | 5.42 | 6.4 |
| 2 | 596 | 635 | 5.74 | 6.5 |
| 3 | 577 | 631 | 6.09 | 9.4 |
| 4 | 591 | 658 | 5.42 | 11.3 |
| 5 | 597 | 691 | 4.49 | 15.7 |
| 6 | 569 | 681 | 5.27 | 19.7 |
| 7 | 599 | 641 | 6.28 | 7.0 |
| 8 | 549 | 699 | 4.86 | 27.3 |
| 9 | 566 | 728 | 4.61 | 28.6 |
| 10 | 586 | 748 | 4.38 | 27.6 |
| 11 | 579 | 650 | 6.47 | 12.3 |
| 12 | 600 | 759 | 4.38 | 26.5 |
| 13 | 599 | 781 | 4.27 | 30.4 |
| 14 | 606 | 689 | 5.27 | 13.7 |
| 15 | 612 | 773 | 3.97 | 26.3 |
| 16 | 625 | 661 | 5.74 | 5.8 |
| 17 | 596 | 648 | 5.91 | 8.7 |
| 18 | 557 | 673 | 5.42 | 20.8 |
| 19 | 601 | 690 | 4.86 | 14.8 |
| 20 | 606 | 726 | 4.99 | 19.8 |
| 21 | 650 | 691 | 5.74 | 6.3 |
| 22 | 610 | 743 | 4.86 | 21.8 |
| 23 | 584 | 692 | 5.27 | 18.5 |
| 24 | 580 | 703 | 5.13 | 21.2 |
| 25 | 595 | 708 | 5.42 | 19.0 |
| 26 | 611 | 680 | 5.74 | 11.3 |
| 27 | 582 | 669 | 5.91 | 14.9 |
| 28 | 591 | 726 | 4.99 | 22.8 |

TABLE 1-continued

| Single Filament Modulus of Pre-stressed Fibers | | | | |
|---|---|---|---|---|
| Test Number | Heat Treated Modulus | Pre-stressed Modulus | Denier | % Increase |
| 29 | 598 | 698 | 5.74 | 16.7 |

Example 2

A sample of VECTRAN® HS yarn, obtained from Hoechst Celanese Corporation, was pre-stressed as described below. The 1500 denier untwisted yarn consists of 300 filaments, so that it has a nominal denier per filament of 5 dpf. The yarn was made from a polyester of about 73% monomer unit II and about 27% monomer unit I and was heat treated prior to pre-stressing. The yarn was pre-stressed by stretching it by about 1.4% between two cold rolls separated by a distance of about 1 to about 1.5 meters. This amount of draw corresponds to about 25% of the tensile strength of the fiber. The fiber speed was about 5 meters per minute, so that the stress was applied for about 12 to about 18 seconds.

Single fibers were taken from the yarn and tested in an Instron mechanical tester at a 1 inch gauge length at a 20% strain rate using ASTM test method D-3822. The mechanical properties of the fiber (average of 10 samples) before pre-stressing were: tenacity, 27.0 gpd; elongation, 5.8%; modulus, 484 gpd. The mechanical properties after pre-stressing (average of 10 measurements) were: tenacity, 29.3 gpd; elongation, 5.8%; modulus, 534 gpd. The modulus thus increased by about 10%.

Example 3

Yarn samples were made from a liquid crystalline polyesteramide made from the following monomers: 6-hydroxy-2-naphthoic acid (3.5 mole %), 4-hydroxybenzoic acid (60 mole %), terephthalic acid (18.25 mole %), 4,4'-biphenol (13.25 mole %) and N-acetyl-4-aminophenol (5 mole %). This polymer, including methods of synthesizing it, is taught in commonly assigned U.S. Pat. No. 5,204, 443, which also discloses the fiber made from this polymer and the heat treatment of the fiber to yield improved properties. It will be noted that the polymer includes recurring monomer units I and II plus three additional monomer units. Untwisted yarn samples were made by extrusion of the polymer through a spinneret, followed by heat treatment for several hours in accordance with U.S. Pat. No. 5,204,443. The yarns had a nominal denier of about 5 dpf.

The yarn samples were pre-stressed on a draw frame at a yarn speed of about 5 meters per minute between two rollers which were about 1 to about 1.5 meters apart and which were held at various temperatures from room temperature to 250° C. The stress was thus applied for about 12 to about 18 seconds. The yarn was stretched by about 1.0% for the pre-stressing at room temperature. This corresponds to a stress of about 10 gpd (assuming that the stress-strain curve is approximately linear). The tensile properties of control samples and pre-stressed samples of the yarn were measured without twist at a 10" gauge length using ASTM test method D-885. The computation of modulus differed slightly from the ASTM test to give a modulus value closer to the origin of the stress-strain curve. The data are presented in Table 2.

The only yarn that showed an improvement in modulus on stretching was Sample 1 in Table 2. This sample had a modulus of 880 gpd before the pre-stressing was carded out, and pre-stressing either at room temperature or at elevated temperature resulted in modest increases in modulus up to about 930 gpd. Samples that had a modulus of greater than 1000 gpd before pre-stressing showed no improvement in properties on the application of stress. Since 1000 gpd is about the maximum observed modulus that is achieved by heat treatment of fiber made from this polymer, it appears that the properties had not fully developed during the heat treatment of Sample 1. Thus, it appears that for this particular composition, an increase in modulus is obtained for fibers that have not fully achieved their properties during heat treatment.

TABLE 2

| Sample No. | Stretch/Temp. (%/°C.) | Tensile Properties Modulus (gpd) | Tenacity (gpd) | Elongation % |
|---|---|---|---|---|
| 1 | Control | 880 | 17.9 | 1.85% |
| 1A | 1.0%/25° | 929 | 17.9 | 1.81% |
| 1B | 1.0%/25° | 931 | 18.0 | 1.79% |
| 1C | 1.0%/160° | 890 | 18.5 | 1.85% |
| 1D | 0.8%/180° | 940 | 18.8 | 1.86% |
| 1E | 0.7%/200° | 898 | 17.9 | 1.82% |
| 2 | Control | 1064 | 20.7 | 1.84% |
| 2A | 1.0%/25° | 1038 | 20.4 | 1.90% |
| 2B | 1.0%/200° | 1049 | 20.5 | 1.93% |
| 3 | Control | 1056 | 17.3 | 1.70% |
| 3A | 1.5%/250° | 1061 | 16.8 | 1.70% |
| 4 | Control | 1023 | 20.2 | 1.93% |
| 4A | 1.5%/250° | 1015 | 19.4 | 1.91% |

It is to be understood that the above-described embodiments of the invention are illustrative only and that modification throughout may occur to one skilled in the art. Accordingly, this invention is not to be regarded as limited to the embodiments disclosed herein.

We claim:

1. A method of increasing the modulus of a heat treated fiber of an aromatic liquid crystalline polymer, comprising the steps of:

(a) applying a stress to the heat treated fiber at a temperature in the range of about 10° C. to about 40° C., said stress being in the range of about 10% to about 90% of the tensile strength of said heat treated fiber; and (b) releasing said stress to yield a pre-stressed fiber having a modulus higher than the modulus of said heat treated fiber, wherein said aromatic liquid crystalline polymer comprises monomer units I and II, where I is

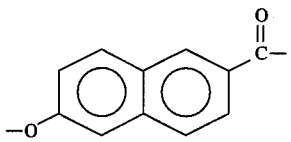

and

II is

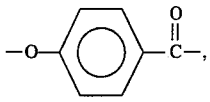

wherein one or more of monomer units I and II may optionally include substituents for one or more of the hydrogen atoms on the aromatic ring selected from the group consisting of alkyl groups having 1 to 4 carbon atoms, fluorinated alkyl groups having 1 to 4 carbon atoms, alkoxy groups having 1 to 4 carbon atoms, halogen atoms, phenyl groups and mixtures thereof.

2. The method as recited in claim 1, wherein said liquid crystalline polymer further comprises monomer units III, IV, and optional monomer unit V, where III is $—O—Ar_1—O—$ IV is

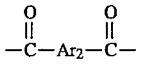

and V is $—X—Ar_3—NR—$ wherein $Ar_1$, $Ar_2$ and $Ar_3$ are each aromatic moieties selected from the group consisting of 1,3-phenylene, 1,4-phenylene, 2,6-naphthylene, 2,7-naphthylene, 4,4'-biphenylene, and mixtures thereof;

wherein —X— is —O— or

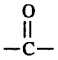

wherein R is —H or an alkyl group having one to four carbon atoms, and wherein $Ar_1$, $Ar_2$ and $Ar_3$ may each optionally include substituents for one or more of the hydrogen atoms in the aromatic ring selected from the group consisting of alkyl groups having 1 to 4 carbon atoms, fluorinated alkyl groups having 1 to 4 carbon atoms, alkoxy groups having 1 to 4 carbon atoms, halogen atoms, phenyl groups and mixtures thereof; and wherein said liquid crystalline polymer comprises about 1 to about 15 mole % of said monomer unit I, about 20 to about 70 mole % of said monomer unit II, about 1 to about 40 mole % of said monomer unit III, about 1 to about 40 mole % of said monomer unit IV, and up to about 20 mole % of said monomer unit V.

3. The method as recited in claim 2, wherein said monomer unit III is

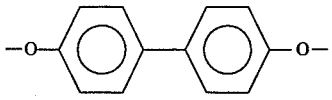

and said monomer unit IV is terephthalate.

4. The method as recited in claim 3, wherein said liquid crystalline polymer consists essentially of about 1 to about 15 mole % of said monomer unit I, about 40 to about 70 mole % of said monomer unit II, about 10 to about 30 mole % of said monomer unit III, and about 10 to about 30 mole % of said monomer unit IV.

5. The method as recited in claim 3, wherein said liquid crystalline polymer consists essentially of about 4 mole % of said monomer unit I, about 60 mole % of said monomer unit II, about 18 mole % of said monomer unit III and about 18 mole % of said monomer unit IV.

6. The method as recited in claim 2, wherein said monomer unit III is

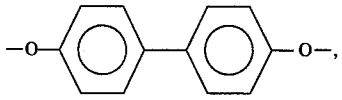

said monomer unit IV is terephthalate, and said optional monomer unit V is

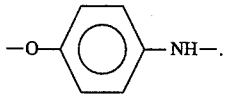

7. The method as recited in claim 6, wherein said liquid crystalline polymer consists essentially of about 1 to about 15 mole % of said monomer unit I, about 20 to about 70 mole % of said monomer unit II, about 5 to about 40 mole % of said monomer unit III, about 5 to about 40 mole % of said monomer unit IV, and about 1 to about 20 mole % of said monomer unit V.

8. The method as recited in claim 6, wherein said liquid crystalline polymer consists essentially of about 3.5 mole % of said monomer unit I, about 60 mole % of said monomer unit II, about 13.25 mole % of said monomer unit III, about 18.25 mole % of said monomer unit IV, and about 5 mole % of said monomer unit V.

9. A method of increasing the modulus of a heat treated fiber of an aromatic liquid crystalline polymer, comprising the steps of:

(a) applying a stress to the heat treated fiber at a temperature in the range of about 10° C. to about 40° C., said stress being in the range of about 10% to about 90% of the tensile strength of said heat treated fiber; and (b) releasing said stress to yield a pre-stressed fiber having a modulus higher than the modulus of said heat treated fiber, wherein said aromatic liquid crystalline polymer consists essentially of about 10 mole % to about 90 mole % of monomer unit I and about 90 mole % to about 10 mole % of monomer unit II, where I is

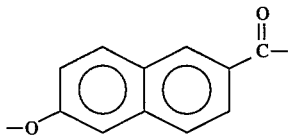

and

II is

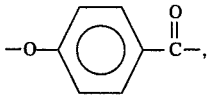

wherein one or more of monomer units I and II may optionally include substituents for one or more of the hydrogen atoms on the aromatic ring selected from the group consisting of alkyl groups having 1 to 4 carbon atoms, fluorinated alkyl groups having 1 to 4 carbon atoms, alkoxy groups having 1 to 4 carbon atoms, halogen atoms, phenyl groups and mixtures thereof.

10. The method as recited in claim 9, wherein said heat treated fiber has a tensile strength of at least about 20 gpd and a tensile modulus of at least about 500 gpd.

11. The method as recited in claim 9, wherein said step of applying a stress to said heat treated fiber is carried out at a temperature of about 25° C.

12. The method as recited in claim 9, wherein said aromatic liquid crystalline polymer consists essentially of about 20 to about 45 mole % of said monomer unit I and about 80 to about 55 mole % of said monomer unit II.

13. The method as recited in claim 9, wherein said aromatic liquid crystalline polymer consists essentially of about 27 mole % of said monomer unit I and about 73 mole % of said monomer unit II.

14. The method as recited in claim 9 wherein said stress applied to said heat treated fiber is in the range of about 25% to about 80% of the tensile strength of said heat treated fiber.

15. The method as recited in claim 9, wherein said stress applied to said heat treated fiber is about 75% of the tensile strength of said heat treated fiber.

16. The method as recited in claim 9, wherein said pre-stressed fiber has a modulus at least about 5% greater than the modulus of said heat treated fiber.

17. The method as recited in claim 13, wherein said stress applied to said heat treated fiber is in the range of about 25% to about 80% of the tensile strength of said heat treated fiber.

18. The method as recited in claim 13, wherein said pre-stressed fiber has a modulus at least about 5% greater than the modulus of said heat treated fiber.

19. The method as recited in claim 9, wherein said stress is applied for a period of about one second to about 1 minute.

20. The method as recited in claim 9, wherein said heat treated fiber has a denier in the range of about 1 to about 10 dpf.

21. The method as recited in claim 9, wherein said heat treated fiber has a denier in the range of about 2 to about 6 dpf.

* * * * *

UNITED STATES PATENT AND TRADEMARK OFFICE

CERTIFICATE OF CORRECTION

PATENT NO. : 5,472,658

DATED : 12/5/95

INVENTOR(S) : G. Collins, W.M Pleban, F. Haimbach IV, and J.A. Flint

It is certified that error appears in the above-identified patent and that said Letters Patent is hereby corrected as shown below:

On the title page, item:

[73], Assignee should read –Hoechst – and not "Holechst-" as indicated

Signed and Sealed this

Twenty-third Day of April, 1996

*Attest:*

*Attesting Officer*

BRUCE LEHMAN

*Commissioner of Patents and Trademarks*